US010145588B2

(12) United States Patent
Nagano et al.

(10) Patent No.: US 10,145,588 B2
(45) Date of Patent: Dec. 4, 2018

(54) EJECTOR REFRIGERATION CYCLE

(71) Applicant: DENSO CORPORATION, Kariya, Aichi-pref. (JP)

(72) Inventors: Youhei Nagano, Kariya (JP); Haruyuki Nishijima, Kariya (JP); Yoshiyuki Yokoyama, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 0 days.

(21) Appl. No.: 15/551,047

(22) PCT Filed: Mar. 4, 2016

(86) PCT No.: PCT/JP2016/001200
§ 371 (c)(1),
(2) Date: Aug. 15, 2017

(87) PCT Pub. No.: WO2016/152048
PCT Pub. Date: Sep. 29, 2016

(65) Prior Publication Data

US 2018/0023847 A1 Jan. 25, 2018

(30) Foreign Application Priority Data

Mar. 23, 2015 (JP) ..... 2015-059091

(51) Int. Cl.
*F25B 1/06* (2006.01)
*F04B 39/04* (2006.01)
(Continued)

(52) U.S. Cl.
CPC ..... *F25B 1/06* (2013.01); *F04B 39/04* (2013.01); *F04B 41/06* (2013.01); *F25B 41/00* (2013.01);
(Continued)

(58) Field of Classification Search
CPC ..... F25B 1/06; F25B 43/02; F25B 2400/23; F25B 2341/0011; F25B 2341/0012
See application file for complete search history.

(56) References Cited

U.S. PATENT DOCUMENTS 1,899,378 A * 2/1933 Zouck ..... F25B 31/004 62/471
2002/0026803 A1* 3/2002 Inoue ..... F25B 13/00 62/228.3
(Continued)

FOREIGN PATENT DOCUMENTS

JP S61036657 A 2/1986
JP 2005024103 A 1/2005
(Continued)

*Primary Examiner* — Cassey D Bauer
(74) *Attorney, Agent, or Firm* — Harness, Dickey & Pierce, P.L.C.

(57) ABSTRACT

An ejector refrigeration cycle has a compressor, a radiator, an ejector, a swirl flow generator, an evaporator, and an oil separator. The compressor compresses refrigerant, mixed with refrigerant oil compatible with a liquid-phase refrigerant, and discharges the high-pressure refrigerant. The ejector has a nozzle and a body having a refrigerant suction port and a pressure increasing part. The swirl flow generator is configured to cause a decompression boiling in the refrigerant by causing the refrigerant to swirl about a center axis of the nozzle. The oil separator separates the refrigerant oil from the high-pressure refrigerant compressed by the compressor and guides the refrigerant oil to flow to a suction side of the compressor. The oil separator decreases a concentration of the refrigerant oil in the refrigerant, which is to flow into the swirl flow generator, so as to promote the decompression boiling of the refrigerant in the swirl flow generator.

8 Claims, 3 Drawing Sheets

(51) Int. Cl.

| | |
|---|---|
| ***F04B 41/06*** | (2006.01) |
| ***F25B 41/00*** | (2006.01) |
| ***F25B 43/02*** | (2006.01) |
| ***F25B 41/06*** | (2006.01) |

(52) U.S. Cl.
CPC ..... *F25B 41/062* (2013.01); *F25B 43/02* (2013.01); *F25B 2341/0011* (2013.01); *F25B 2341/0012* (2013.01); *F25B 2400/23* (2013.01); *F25B 2500/18* (2013.01)

(56) References Cited

U.S. PATENT DOCUMENTS

| | | | |
|---|---|---|---|
| 2004/0261448 | A1 | 12/2004 | Nishijima et al. |
| 2005/0028552 | A1 | 2/2005 | Nishijima et al. |
| 2012/0042686 | A1 | 2/2012 | Oshitani |
| 2012/0067077 | A1 | 3/2012 | Kayano et al. |
| 2012/0247146 | A1 | 10/2012 | Yamada et al. |
| 2014/0020424 | A1 | 1/2014 | Suzuki et al. |
| 2015/0033790 | A1 | 2/2015 | Yamada et al. |
| 2016/0047586 | A1 | 2/2016 | Kayano et al. |
| 2016/0169566 | A1 | 6/2016 | Nakashima et al. |

FOREIGN PATENT DOCUMENTS

| | | | |
|---|---|---|---|
| JP | 2005055113 | A | 3/2005 |
| JP | 2008064327 | A | 3/2008 |
| JP | 2012042113 | A | 3/2012 |
| JP | 2012063087 | A | 3/2012 |
| JP | 2012202652 | A | 10/2012 |
| JP | 2012202653 | A | 10/2012 |
| JP | 2013177879 | A | 9/2013 |
| JP | 2014190229 | A | 10/2014 |
| JP | 2015031405 | A | 2/2015 |
| WO | WO-2013140992 | A1 | 9/2013 |
| WO | WO-2015019564 | A1 | 2/2015 |

* cited by examiner

EJECTOR REFRIGERATION CYCLE

CROSS REFERENCE TO RELATED APPLICATIONS

This application is a U.S. National Phase Application under 35 U.S.C. 371 of International Application No. PCT/JP2016/001200 filed on Mar. 4, 2016 and published in Japanese as WO 2016/152048 A1 on Sep. 29, 2016. This application is based on and claims the benefit of priority from Japanese Patent Application No. 2015-059091 filed on Mar. 23, 2015. The entire disclosures of all of the above applications are incorporated herein by reference.

TECHNICAL FIELD

The present disclosure relates to an ejector refrigeration cycle having an ejector.

BACKGROUND ART

An ejector refrigeration cycle is known as a vapor compression refrigeration cycle device that has an ejector serving as a refrigerant decompressor.

An ejector disposed in such an ejector refrigeration cycle has a nozzle that defines a refrigerant passage (i.e., a nozzle passage) therein, a refrigerant suction port, and a pressure increasing part (i.e., a diffuser passage). An injection refrigerant is injected from the refrigerant passage at a high speed. The refrigerant suction port draws refrigerant, which flows from an evaporator, using suction power of the injection refrigerant as a suction refrigerant. The diffuser passage increases a pressure of mixed refrigerant of the injection refrigerant and the suction refrigerant. The refrigerant of which pressure is increased in the diffuser passage flows to a suction side of a compressor.

As a result, a pressure of the refrigerant drawn into the compressor can be high according to the ejector refrigeration cycle, as compared to a normal refrigeration cycle in which an evaporating pressure of refrigerant in the evaporator is substantially equal to a pressure of the refrigerant drawn into the compressor. Therefore, according to the ejector refrigeration cycle, consumption power of the compressor can be reduced, thereby improving a coefficient of performance (COP) of the ejector refrigeration cycle, as compared to the normal refrigeration cycle.

Patent Literature 1 discloses an ejector that further has a swirl causing part (i.e., a swirl space) causing refrigerant to swirl before flowing into the nozzle passage. The ejector disclosed in Patent Literature 1 causes a subcooled liquid-phase refrigerant to swirl in the swirl space such that refrigerant swirling about a swirl center is decompression boiled, thereby biphasic refrigerant flows into the nozzle passage. The biphasic refrigerant in this case means a refrigerant having gas-phase refrigerant swirling on an outer side in the swirl space and liquid-phase refrigerant being concentrated on an inner side and swirling about the swirl center.

It is an objective of the ejector disclosed in Patent Literature 1 to facilitate a boiling of the refrigerant in the nozzle passage, and thereby to improve energy conversion efficiency in a conversion of pressure energy of the refrigerant to kinetic energy in the nozzle passage. In addition, it is another objective of the ejector to increase a pressure increase degree of the refrigerant in the diffuser passage by improving the energy conversion efficiency, and thereby to further improve the COP of the ejector refrigeration cycle.

PRIOR ART LITERATURES

Patent Literature

Patent Literature 1: JP 2013-177879 A

SUMMARY OF INVENTION

According to the ejector refrigeration cycle disclosed in Patent Literature 1, refrigerant oil for lubricating the compressor is mixed into the refrigerant. Generally, this kind of refrigerant oil is compatible with liquid-phase refrigerant.

The present disclosure addresses the above-described issues, and it is an objective of the present disclosure to provide an ejector refrigeration cycle in which refrigerant mixed with refrigerant oil circulates, and which can improve a coefficient of performance (COP) sufficiently.

An ejector refrigeration cycle according to the present disclosure has a compressor, a radiator, an ejector, a swirl flow generator, an evaporator, and an oil separator.

The compressor compresses refrigerant mixed with refrigerant oil and discharges the refrigerant. The radiator causes a high-pressure refrigerant discharged by the compressor to radiate heat to be a subcooled liquid-phase refrigerant. The ejector has a nozzle and a body. The nozzle decompresses the refrigerant flowing from the radiator and injects the refrigerant as an injection refrigerant at a high speed. The body has a refrigerant suction port and a pressure increasing part. The refrigerant suction port draws the refrigerant, as a suction refrigerant, using suction power of the injection refrigerant. The pressure increasing part mixes the injection refrigerant and the suction refrigerant and increases a pressure of a mixture of the injection refrigerant and the suction refrigerant. The swirl flow generator causes the refrigerant flowing from the radiator to swirl about a center axis of the nozzle and to flow into the nozzle. The evaporator evaporates the refrigerant and guides the refrigerant to the refrigerant suction port. The oil separator separates the refrigerant oil from the high-pressure refrigerant compressed by the compressor and guides the refrigerant oil to flow to a suction side of the compressor.

Accordingly, the refrigerant concentrated around a swirl center can be decompression-boiled in the swirl flow generator. The gas-phase refrigerant is generated while the refrigerant is decompression-boiled, and is supplied, as a nucleus causing a boiling, to the refrigerant flowing in a refrigerant passage defined in the nozzle. As a result, a boiling of the refrigerant flowing in the refrigerant passage in the nozzle is promoted, and thereby energy conversion efficiency in a conversion of pressure energy of the refrigerant into kinetic energy performed in the nozzle can be improved.

In addition, the oil separator can separate the refrigerant oil from the refrigerant flowing into the swirl flow generator. Accordingly, a decrease of a vapor pressure of the refrigerant flowing into the swirl flow generator can be suppressed, and thereby the energy conversion efficiency in the refrigerant passage defined in the nozzle can be improved sufficiently.

As a result, the coefficient of performance (COP) of the ejector refrigeration cycle in which the refrigerant mixed with the refrigerant oil circulates can be improved sufficiently.

Here, according to the present disclosure, "the high-pressure refrigerant compressed by the compressor" is not limited to refrigerant discharged by the compressor and includes the high-pressure refrigerant inside the compressor. The refrigerant discharged by the compressor is, e.g., refrigerant in a refrigerant passage extending from a discharge port of the compressor to an inlet of the swirl flow generator.

In addition, "a suction side of the compressor" is not limited to a refrigerant passage in which refrigerant flows to be drawn into the compressor, and includes a refrigerant passage in which a low-pressure refrigerant in the compressor before being decompressed. The refrigerant passage in which refrigerant flows to be drawn into the compressor is, e.g., a refrigerant passage extending from an outlet of the pressure increasing part to a suction port of the compressor.

BRIEF DESCRIPTION OF DRAWINGS

The above and other objects, features and advantages of the present disclosure will become more apparent from the following detailed description made with reference to the accompanying drawings.

DESCRIPTION OF EMBODIMENTS

Embodiments of the present disclosure will be described hereinafter referring to drawings. In the embodiments, a part that corresponds to or equivalents to a part described in a preceding embodiment may be assigned with the same reference number, and a redundant description of the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

Figure 1:
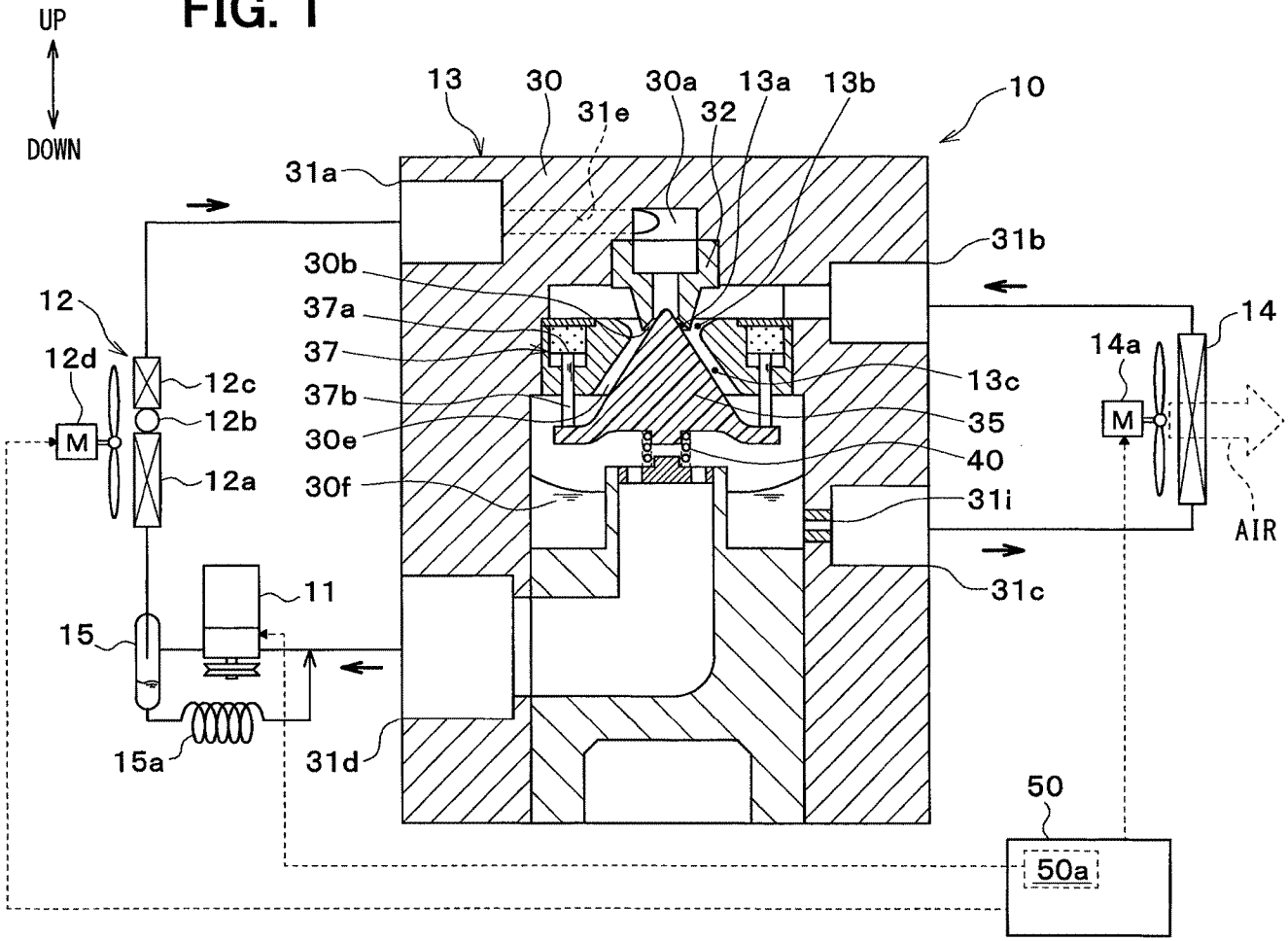
FIG. 1 is a diagram illustrating a whole configuration of an ejector refrigeration cycle according to a first embodiment.

A first embodiment will be described hereafter referring to FIG. 1 to FIG. 3. FIG. 1 illustrates a whole configuration of an ejector refrigeration cycle 10 according to the present embodiment. The ejector refrigeration cycle 10 is disposed in a vehicle air conditioner and cools air that is supplied into a vehicle compartment (i.e., an interior space) as an air-conditioning target space. That is, a cooling target fluid being cooled by the ejector refrigeration cycle 10 is the air that is supplied into the vehicle compartment.

The ejector refrigeration cycle 10 uses HFC series refrigerant (specifically, R134a) as refrigerant and configures a subcritical refrigeration cycle in which a refrigerant pressure on a high-pressure side does not exceed a critical pressure of the refrigerant. The refrigerant is mixed with refrigerant oil to lubricate a compressor 11. The refrigerant oil is compatible with a liquid-phase refrigerant.

The compressor 11, disposed in the ejector refrigeration cycle 10, draws the refrigerant, compresses the refrigerant to be a high-pressure refrigerant, and discharges the high-pressure refrigerant. The compressor 11 is located inside an engine chamber with an internal combustion engine (i.e., an engine) (not shown) that outputs a driving force moving a vehicle. The compressor 11 is driven by a rotational driving force that is generated by the engine and transmitted through a pulley, a belt, etc. (not shown).

Specifically, according to the present embodiment, the compressor 11 is a swash-plate variable capacity compressor that is capable of adjusting a refrigerant discharge capacity by changing a discharge amount of the refrigerant. The compressor 11 has a discharge capacity control valve (not shown) that changes the discharge amount. The discharge capacity control valve is operated based on a control current output from an air conditioning controller 50 that will be described later.

The compressor 11 has a discharge port connecting to an inlet side of an oil separator 15. The oil separator 15 separates the refrigerant oil from the high-pressure refrigerant discharged by the compressor 11. More specifically, the oil separator 15 separates the refrigerant oil from the high-pressure refrigerant compressed in the compressor 11 and guides the refrigerant oil to a suction side of the compressor 11.

According to the present embodiment, the oil separator 15 is a centrifugal separation type separator that separates the refrigerant oil from a gas-phase refrigerant using centrifugal force. Specifically, the oil separator 15 has a tubular portion that extends in a vertical direction and defines a columnar space therein. The columnar space causes the refrigerant discharged by the compressor 11 to swirl therein, thereby separating the refrigerant oil from the gas-phase refrigerant.

The oil separator 15 has an upper part provided with a gas-phase refrigerant outlet. The gas-phase refrigerant from which the refrigerant oil is separated flows out of the gas-phase refrigerant outlet. The gas-phase refrigerant outlet connects to a refrigerant inlet side of a condensing portion 12*a* of a radiator 12.

The oil separator 15 further has a lower part provided with an oil storage part and a refrigerant oil outlet. The oil storage part stores the refrigerant oil separated from the gas-phase refrigerant. The refrigerant oil stored in the oil storage part flows out of the refrigerant oil outlet. The refrigerant oil outlet connects to the suction side of the compressor 11 through a capillary tube 15*a* serving as a fixed throttle.

The radiator 12 is a heat radiation heat exchanger that performs a heat exchange between the high-pressure refrigerant discharged by the compressor 11 and air (i.e., outside air) supplied from an outside of the vehicle compartment by a cooling fan 12*d*, thereby cooling the high-pressure refrigerant by causing the high-pressure refrigerant to radiate heat.

More specifically, the radiator 12 is so-called subcooling condenser having the condensing portion 12*a*, a receiver 12*b*, and a subcooling portion 12*c*. The condensing portion 12*a* performs a heat exchange between a high-pressure gas-phase refrigerant discharged by the compressor 11 and the outside air supplied by the cooling fan 12*d*, thereby condensing the high-pressure gas-phase refrigerant by causing the high-pressure gas-phase refrigerant to radiate heat. The receiver 12*b* separates the refrigerant flowing out of the condensing portion 12*a* into gas-phase refrigerant and liquid-phase refrigerant and stores an excess liquid-phase refrigerant. The subcooling portion 12*c* performs a heat exchange between the liquid-phase refrigerant flowing out of the receiver 12*b* and the outside air supplied by the cooling fan 12*d*, thereby subcooling the liquid-phase refrigerant.

The cooling fan 12*d* is an electric blower of which rotation speed (i.e., air volume to blow) is controlled based on a control voltage output from the air conditioning controller 50.

A refrigerant outlet side of the subcooling portion 12*c* of the radiator 12 connects to a refrigerant inlet 31*a* of an ejector 13. The ejector 13 serves as a refrigerant decompressor that decompresses a high-pressure liquid-phase refrigerant, flowing from the radiator 12 in a subcooled state, and guides the high-pressure liquid-phase refrigerant to a downstream side of the ejector 13. The ejector 13 also serves as a refrigerant circulator (i.e., a refrigerant transit member) that circulates the refrigerant in a manner that refrigerant, flowing out of an evaporator 14 described later, is drawn (i.e., transported) into the ejector 13 using suction power of refrigerant (i.e., a refrigerant flow) injected at a high speed.

The ejector 13 further serves as a gas-liquid separator that separates the refrigerant, after being decompressed, into gas-phase refrigerant and liquid-phase refrigerant. That is, the ejector 13 of the present embodiment is configured as an ejector (i.e., an ejector module) having a gas-liquid separating function.

Here, arrows indicating up and down in FIG. 1 indicate an upper direction and a lower direction on a condition that the ejector 13 is disposed in the vehicle. Accordingly, an upper direction and a lower direction on a condition that devices configuring the ejector refrigeration cycle are disposed in the vehicle are not limited to the upper direction and the lower direction shown in FIG. 1. FIG. 1 illustrates a cross-sectional view of the ejector 13 taken along a line parallel to an axial direction of the ejector 13.

As shown in FIG. 1, the ejector 13 of the present embodiment has a body 30 that is configured by assembling members. The body 30 is made of metal or resin and has a prismatic shape or a cylindrical shape. The body 30 is provided with refrigerant inlets, refrigerant outlets, and chambers.

The refrigerant inlets and the refrigerant outlets provided in the body 30 include the refrigerant inlet 31*a*, a refrigerant suction port 31*b*, a liquid-phase refrigerant outlet 31*c*, and a gas-phase refrigerant outlet 31*d*. The refrigerant inlet 31*a* guides the refrigerant flowing out of the radiator 12 into the body 30. The refrigerant suction port 31*b* draws the refrigerant flowing from the evaporator 14. The liquid-phase refrigerant outlet 31*c* guides the liquid-phase refrigerant, which is separated in a gas-liquid separating space 30*f* defined inside the body 30, to flow to a refrigerant inlet side of the evaporator 14. The gas-phase refrigerant outlet 31*d* guides the gas-phase refrigerant, which is separated in the gas-liquid separating space 30*f*, to flow to the suction side of the compressor 11.

The chambers defined in the body 30 include a swirl space 30*a*, a decompression space 30*b*, a pressure increasing space 30*e*, and the gas-liquid separating space 30*f*. The swirl space 30*a* cause the refrigerant flowing from the refrigerant inlet 31*a* to swirl. The decompression space 30*b* decompresses the refrigerant flowing out of the swirl space 30*a*. The pressure increasing space 30*e* increases a pressure of the refrigerant flowing out of the decompression space 30*b*. The gas-liquid separating space 30*f* separates the refrigerant flowing out of the pressure increasing space 30*e* into the gas-phase refrigerant and the liquid-phase refrigerant.

The swirl space 30*a* and the gas-liquid separating space 30*f* have substantially columnar shapes as a solid of revolution. The decompression space 30*b* and the pressure increasing space 30*e* have, as a solid of revolution, substantially truncated cone shapes of which sectional areas increase from a side adjacent to the swirl space 30*a* to a side adjacent to the gas-liquid separating space 30*f* respectively. The spaces are arranged coaxially with each other. Here, the solid of revolution is a solid figure obtained by rotating a plane around a straight line (i.e., the center axis) that lies on the same plane.

A nozzle 32 is fixed in the body 30 by a method such as press fitting. The nozzle 32 is a tubular member made of metal (e.g., a stainless alloy) and has a substantially cone shape that narrows toward a downstream side in a flow direction of the refrigerant. The swirl space 30*a* is located above the nozzle 32, and the decompression space 30*b* is located inside the nozzle 32.

A refrigerant inlet passage 31*e* connects the refrigerant inlet 31*a* and the swirl space 30*a* to each other. The refrigerant inlet passage 31*e* extends in a tangential direction of an inner wall surface of the swirl space 30*a* when viewed in a direction in which the center axis of the swirl space 30*a* extends. Accordingly, the refrigerant flowing into the swirl space 30*a* from the refrigerant inlet passage 31*e* flows along the inner wall surface of the swirl space 30*a*, and thereby swirling about the center axis of the swirl space 30*a*.

Here, since centrifugal force has effect on the refrigerant swirling in the swirling space 30*a*, a pressure of the refrigerant adjacent to the center axis becomes lower than a pressure of the refrigerant on an outer side in the swirl space 30*a*. Then, according to the present embodiment, dimensions of the swirl space 30*a* etc. are set such that the pressure of the refrigerant adjacent to the center axis in the swirl space 30*a* decreases to a specified pressure at which the refrigerant adjacent to the center axis becomes a saturated liquid-phase refrigerant or at which the refrigerant is decompression-boiled (i.e., at which cavitation occurs), in a normal operation of the ejector refrigeration cycle 10.

Such an adjustment of the pressure of the refrigerant adjacent to the center axis in the swirl space 30*a* can be performed by adjusting a swirl speed of the refrigerant swirling in the swirl space 30*a*. In addition, the swirl speed can be adjusted, for example, by setting the dimensions to obtain a required ratio between a passage sectional area of the refrigerant inlet passage and a sectional area of the swirl space 30*a* taken along a line perpendicular to the center axis. The swirl speed is a flow speed of the refrigerant in a swirl direction at an outer most part of the swirl space 30*a* in a radial direction.

Accordingly, parts of the body 30 and the nozzle 32 defining the swirl space 30*a* and the swirl space 30*a* configure a swirl flow generator. The swirl flow generator causes the refrigerant flowing from the radiator 12 to swirl in the swirl space 30*a* and to flow into a refrigerant passage defined in the nozzle 32. The refrigerant passage defined in the nozzle 32 is a nozzle passage 13*a* described later. That is, according to the present embodiment, the ejector 13 and the swirl flow generator are provided integrally with each other.

The body 30 defines a suction passage 13*b* therein. The suction passage 13*b* guides the refrigerant drawn by the refrigerant suction port 31*b* to flow to an area located on a downstream side of the decompression space 30*b* and on an upstream side of the pressure increasing space 30*e* in the flow direction of the refrigerant.

A passage defining member 35 made of resin is located in the decompression space 30*b* and the pressure increasing space 30*e*. The passage defining member 35 has a substantially cone shape widening outward as being separated from the decompression space 30*b*. The passage defining member 35 is also located coaxially with the spaces including the decompression space 30*b*.

A refrigerant passage is defined between an inner surface of a part of the body 30 defining the decompression space 30*b* and the pressure increasing space 30*e* and a side surface (i.e., a side surface of the cone shape) of the passage defining member 35 in a direction perpendicular to the axial direction. The refrigerant passage has an annular shape in cross section perpendicular to the axial direction. The annular shape is, e.g., a doughnut shape defined by a circle excluding a smaller circle located coaxially with the circle. That is, the refrigerant passage is defined by the inner surface of the body 30 and the side surface of the passage defining member 35 and has the annular shape (i.e., the doughnut shape) in the cross section perpendicular to the axial direction.

The refrigerant passage has a refrigerant path defined between a part of the nozzle 32 defining the decompression space 30*b* and a part of the side surface of the passage defining member 35 on a side adjacent to a tip of the passage defining member 35. The refrigerant path has a shape of which passage sectional area decreases toward a downstream side in the flow direction of the refrigerant. According to the shape, the refrigerant path provides the nozzle passage 13*a* serving as a nozzle that decreases a pressure of the refrigerant isentropically and injects the refrigerant.

More specifically, the nozzle passage 13*a* of the present embodiment has the shape in which the passage sectional area gradually decreases from an inlet of the nozzle passage 13*a* toward a minimum sectional area part (i.e., a minimum passage sectional area part) and the passage sectional area gradually increases from the minimum sectional area part toward an outlet of the nozzle passage 13*a*. That is, the passage sectional area (i.e., a refrigerant passage sectional area) of the nozzle passage 13*a* varies similar to Laval nozzle according to the present embodiment.

The refrigerant passage further has a refrigerant path defined between a part of the body 30 defining the pressure increasing space 30*e* and the side surface of the passage defining member 35. The refrigerant path has a shape of which passage sectional area gradually increases toward the downstream side in the flow direction of the refrigerant. According to the shape, the refrigerant path provides a diffuser passage 13*c* serving as a diffuser (i.e., a pressure increasing part) that mixes an injection refrigerant, which is injected by the nozzle passage 13*a*, and a suction refrigerant, which is drawn by the refrigerant suction port 31*b*, and increases a pressure of a mixture of the injection refrigerant and the suction refrigerant.

An element 37 is arranged in the body 30 as a driving part (i.e., a driving mechanism) that changes the passage sectional area of the minimum sectional area part of the nozzle passage 13*a* by moving the passage defining member 35. More specifically, the element 37 has a diaphragm 37*a* that moves based on a temperature and a pressure of the refrigerant flowing through the suction passage 13*b* (i.e., the refrigerant flowing out of the evaporator 14).

The diaphragm 37*a* moves in a direction (i.e., downward in the vertical direction) in which the passage sectional area of the minimum sectional area part of the nozzle passage 13*a* increases as the temperature (i.e., a superheat degree) of the refrigerant flowing out of the evaporator 14 rises. The diaphragm 37*a* moves in a direction (i.e., upward in the vertical direction) in which the passage sectional area of the minimum sectional area part of the nozzle passage 13*a* decreases as the temperature (i.e., the superheat degree) of the refrigerant flowing out of the evaporator 14 falls. The movement of the diaphragm 37*a* transmits to the passage defining member 35 through an actuation rod 37*b*.

The passage defining member 35 receives a load from a coil spring 40 serving as an elastic member. The coil spring 40 applies the load to the passage defining member 35 to bias the passage defining member 35 in a direction in which the passage sectional area of the minimum sectional area part of the nozzle passage 13*a* decreases.

Accordingly, the passage defining member 35 moves such that an inlet-side load, an outlet-side load, an element load, and an elastic-member-side load are balanced. The inlet-side load is applied to the passage defining member 35 by a pressure of a high-pressure refrigerant flowing on a side adjacent to the swirl space 30*a* (i.e., refrigerant flowing on a side adjacent to an inlet of the nozzle passage 13*a*). The outlet-side load is applied to the passage defining member 35 by a pressure of a low-pressure refrigerant flowing on a side adjacent to the gas-liquid separating space 30*f* (i.e., refrigerant flowing on a side adjacent to an outlet of the diffuser passage 13*c*). The element load is applied to the passage defining member 35 from the element 37 through the actuation rod 37*b*. The elastic-member-side load is applied to the passage defining member 35 from the coil spring 40.

That is, the passage defining member 35 moves to increase the passage sectional area of the minimum sectional area part of the nozzle passage 13*a* as the temperature (i.e., the superheat degree) of the refrigerant flowing out of the evaporator 14 rises. On the other hand, the passage defining member 35 moves to decrease the passage sectional area of the minimum sectional area part of the nozzle passage 13*a* as the temperature (i.e., the superheat degree) of the refrigerant flowing out of the evaporator 14 falls.

According to the present embodiment, the passage sectional area of the minimum sectional area part of the nozzle passage 13*a* is adjusted such that a superheat degree SH of the refrigerant flowing on a side adjacent to the evaporator 14 is controlled to approach a predetermined reference superheat degree KSH, in a manner that the passage defining member 35 moves depending on the superheat degree of the refrigerant flowing out of the evaporator 14 as described above.

The gas-liquid separating space 30*f* is located below the passage defining member 35. The gas-liquid separating space 30*f* configures a centrifugal gas-liquid separator that causes the refrigerant flowing out of the diffuser passage 13*c* to swirl about the center axis and separates the refrigerant into the gas-phase refrigerant and the liquid-phase refrigerant using centrifugal force.

The gas-liquid separating space 30*f* has a capacity that cannot store an excess refrigerant substantively even when a volume of the refrigerant circulating in the refrigeration cycle is changed when a load change occurs in the refrigeration cycle. The gas-liquid separating space 30*f* and the liquid-phase refrigerant outlet 31*c* are connected to each other by a liquid-phase refrigerant passage. An orifice 31*i* is located in the liquid-phase refrigerant passage and serves as a decompressor that decompresses the refrigerant flowing into the evaporator 14.

The liquid-phase refrigerant outlet 31*c* of the ejector 13 connects to the refrigerant inlet side of the evaporator 14. The evaporator 14 is a heat absorbing heat exchanger that performs a heat exchange between the low-pressure refrigerant decompressed by the ejector 13 and air, which is supplied by a blower fan 14*a* and blown into the vehicle compartment, such that causes the low-pressure refrigerant to absorb heat by being evaporated. The blower fan 14*a* is an electric blower of which rotational speed (i.e., a volume of air to blow) is controlled based on a control voltage output from the air conditioning controller 50.

The evaporator 14 has a refrigerant outlet that connects to the refrigerant suction port 31*b* of the ejector 13. The gas-phase refrigerant outlet 31*d* of the ejector 13 connects to the suction side of the compressor 11.

As described above, the refrigerant oil separated by the oil separator 15 returns to the suction side of the compressor 11 through the capillary tube 15*a*. Specifically, the refrigerant oil returns, through the capillary tube 15*a*, to a refrigerant passage extending from the gas-phase refrigerant outlet 31*d* of the ejector 13 to the suction port of the compressor 11.

That is, the oil separator 15 is disposed to reduce a concentration of the refrigerant oil in a subcooled liquid-phase refrigerant flowing into the swirl space 30*a* of the ejector 13. In other words, the oil separator is located upstream of the swirl flow generator in the flow direction of the refrigerant and is disposed to reduce a concentration of the refrigerant oil in the liquid-phase refrigerant flowing into the swirl flow generator.

A schematic configuration of an electric controller of the present embodiment will be described hereafter. The air conditioning controller 50 is configured by a well-known microcomputer having CPU, ROM, RAM, etc. and peripheral circuits. The air conditioning controller 50 performs calculations and processing based on control programs stored in ROM and controls operations of electric actuators etc. that operate the compressor 11, the cooling fan 12*d*, the blower fan 14*a*, etc.

The air conditioning controller 50 connects to various sensors such as an inside temperature sensor, an outside temperature sensor, an insolation sensor, an evaporator temperature sensor, and a refrigerant discharge pressure sensor. Detection values detected by the various sensors are input to the air conditioning controller 50. The inside temperature sensor detects a temperature (i.e., inside temperature) Tr inside the vehicle compartment. The outside temperature sensor detects an outside temperature Tam. The insolation sensor detects an insolation amount As radiated into the vehicle compartment. The evaporator temperature sensor detects a refrigerant evaporating temperature (i.e., an evaporator temperature) Te in the evaporator 14. The refrigerant discharge pressure sensor detects a pressure (i.e., a refrigerant discharge pressure) Pd of the refrigerant discharged by the compressor 11.

According to the present embodiment, the evaporator temperature sensor detects a temperature of a heat exchanger fin of the evaporator 14. However, the evaporator temperature sensor may be a temperature sensor that detects a temperature at other parts of the evaporator 14. Alternatively, the evaporator temperature sensor may be a temperature sensor that detects a temperature of the refrigerant flowing through the evaporator 14 or a temperature of the refrigerant on an outlet side of the evaporator 14.

The input side of the air conditioning controller 50 connects to a operation panel (not shown) that is arranged adjacent to an instrument panel located in a front area of the vehicle compartment. The operation panel is provided with various operation switches, and operation signals from the operation switches are input to the air conditioning controller 50. The operation switches provided in the operation panel includes an air conditioning operation switch for requesting the vehicle air conditioner to operate an air conditioning for the vehicle compartment and an inside temperature setting switch that sets a vehicle compartment interior temperature Tset in the vehicle compartment.

The air conditioning controller 50 of the present embodiment is configured integrally with a control sections that control operations of various control target devices connected to an output side of the air conditioning controller 50. The air conditioning controller 50 has a configuration (hardware and software) that controls the operations of the control target devices, and the configuration configures the control sections for the control target devices.

For example, according to the present embodiment, a configuration controlling a refrigerant discharge capacity of the compressor 11 configures a discharge capacity controller 50*a* by controlling an operation of the discharge capacity control valve of the compressor 11. The discharge capacity controller 50*a* may be configured by a controller provided separately from the air conditioning controller 50.

An operation of the present embodiment with the above-described configuration will be described hereafter. According to the vehicle air conditioner of the present embodiment, the air conditioning controller 50 performs an air conditioning program stored in the air conditioning controller 50 in advance when an air conditioning operation switch, which is provided in the operation panel, is operated (ON).

In the air conditioning operation switch, the detection signals from the various sensors for performing the air conditioning and the operation signals from the operation panel are read. A target blowing temperature TAO that is a target temperature of air to be blown into the vehicle compartment is calculated based on the detection signals and the operation signals.

The target blowing temperature TAO is calculated using the following formula F1.

$$TAO = Kset \times Tset - Kr \times Tr - Kam \times Tam - Ks \times As + C \quad (F1)$$

Tset represents the vehicle compartment interior temperature of that is set by a temperature setting switch. Tr represents the inside temperature detected by the inside temperature sensor. Tam represents the outside temperature detected by the outside temperature sensor. As represents the insolation amount detected by the insolation sensor. Kset, Kr, Kam, and Ks are control gains, and C is a constant for a correction.

The air conditioning program determines operation states of the various control target devices connected to the output side of the air conditioning controller 50 based on the target blowing temperature TAO and the detection signals from the various sensors. In other words, the air conditioning program determines control signals, control voltages, control currents, and control pulses output to the control target devices.

For example, the refrigerant discharge capacity of the compressor, i.e., a control current output to the discharge capacity control valve of the compressor 11, is determined as follows. A target evaporating temperature TEO at which the refrigerant evaporates in the evaporator 14 is determined first using the target blowing temperature TAO and referring to a control map that is stored in a storage circuit of the air conditioning controller 50 in advance.

The control current output to the discharge capacity control valve of the compressor 11 is determined based on a deviation (TEO-Te) between the refrigerant evaporating temperature Te detected by the evaporator temperature sensor and the target evaporating temperature TEO, such that the refrigerant evaporating temperature Te approaches to the target evaporating temperature TEO by a feedback control.

More specifically, according to the air conditioning program of the present embodiment, the discharge capacity controller 50*a* controls a discharge volume (i.e., the refrigerant discharge capacity) of the compressor 11 to increase a volume of the refrigerant circulating in the refrigeration cycle as a temperature difference between the target evaporating temperature TEO and the refrigerant evaporating temperature Te increases, i.e., as a thermal load in the ejector refrigeration cycle 10 increases.

As for a blowing capacity of the blower fan 14*a*, i.e., a control voltage output to the blower fan 14*a*, the control voltage is determined based on the target blowing temperature TAO and referring to a control map stored in the storage circuit of the air conditioning controller 50 in advance.

More specifically, the control voltage is determined using the control map such that the blowing capacity of the blower fan 14*a* becomes a substantially maximum value when the target blowing temperature TAO is within an extremely low temperature range or an extremely high temperature range. In addition, the control voltage is determined to decrease the blowing capacity of the blower fan 14*a* from the substantially maximum value gradually as the target blowing temperature TAO varies from the extremely low temperature range or the extremely high temperature range to an intermediate temperature range.

The air conditioning controller 50 outputs the determined control signals etc. to the control target devices. Subsequently, a control routine of reading the detection signals and the operation signals, calculating the target blowing temperature TAO, determining the operation states of the control target devices, and outputting the control signals is performed repeatedly in every control cycle until a stop of the operation of the vehicle air conditioner is requested.

Accordingly, the refrigerant circulates as shown by thick solid arrows in FIG. 1 in the ejector refrigeration cycle 10 in a normal operation state. A state of the refrigerant varies as shown in a Mollier diagram shown in FIG. 2.

More specifically, a high-temperature high-pressure refrigerant (at a point a in FIG. 2) discharged by the compressor 11 flows into the condensing portion 12*a* of the radiator 12 and exchanges heat with the outside air blown by the cooling fan 12*d*, thereby radiating heat and being condensed. The refrigerant condensed in the condensing portion 12*a* is separated into the gas-phase refrigerant and the liquid-phase refrigerant in the receiver 12*b*. The liquid-phase refrigerant separated in the receiver 12*b* exchanges heat with the outside air, which is blown by the cooling fan 12*d*, in the subcooling portion 12*c*, and thereby further radiating heat and being a subcooled liquid-phase refrigerant (from the point a to a point bin FIG. 2).

Figure 2:
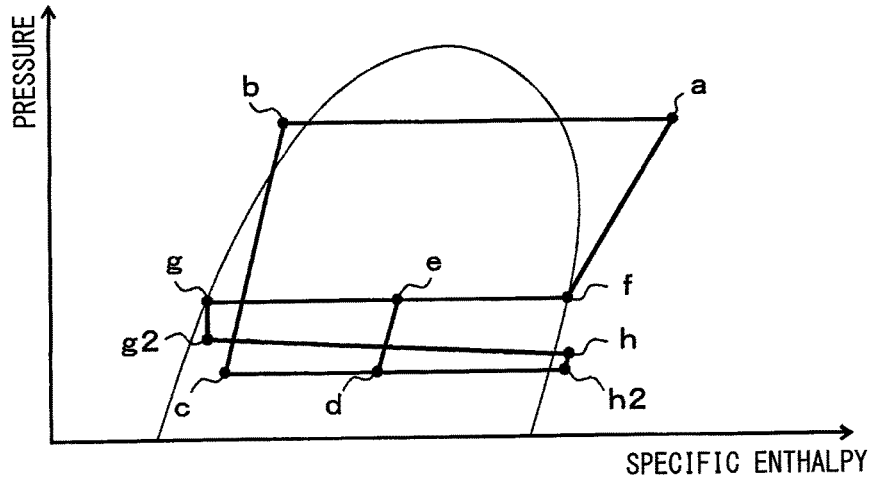
FIG. 2 is a Mollier diagram showing a state of refrigerant in the ejector refrigeration cycle according to the first embodiment.

The subcooled liquid-phase refrigerant flowing out of the subcooling portion 12*c* of the radiator 12 is decompressed isentropically in the nozzle passage 13*a* of the ejector 13 and injected from the nozzle passage 13*a* (from the point b to a point c in FIG. 2). At this time, the element 37 of the ejector 13 moves the passage defining member 35 such that the superheat degree SH of the refrigerant on the outlet side of the evaporator 14 (at a point h in FIG. 2) approaches the predetermined reference superheat degree KSH.

The refrigerant flowing out of the evaporator 14 (at the point h in FIG. 2) is drawn, as a suction refrigerant, from the refrigerant suction port 31*b* due to suction power of an injection refrigerant injected from the nozzle passage 13*a*. The injection refrigerant injected from the nozzle passage 13*a* and the suction refrigerant drawn from the refrigerant suction port 31*b* are mixed and the mixed refrigerant flows into the diffuser passage 13*c* (from the point c to a point d, from a point h2 to the point d, in FIG. 2).

The suction passage 13*b* of the present embodiment has a shape of which passage sectional area gradually decreases toward a downstream side in the flow direction of the refrigerant. Accordingly, a flow speed of the suction refrigerant passing through the suction passage 13*b* increases as a pressure of the suction refrigerant falls (from the point h to the point h2 in FIG. 2). As a result, a flow speed difference between the suction refrigerant and the injection refrigerant decreases, and thereby an energy loss (i.e., a mixing loss) caused when the suction refrigerant and the injection refrigerant are mixed in the diffuser passage 13*c* is decreased.

Since the passage sectional area (i.e., the refrigerant passage sectional area) of the diffuser passage 13*c* increases, kinetic energy of the refrigerant is converted into pressure energy. Accordingly, a pressure of the mixed refrigerant increases as the injection refrigerant and the suction refrigerant are mixed (from the point d to a point e in FIG. 2). The refrigerant flowing out of the diffuser passage 13*c* is separated into the gas-phase refrigerant and the liquid-phase refrigerant in the gas-liquid separating space 30*f* (from the point e to a point f, from the point e to a point g, in FIG. 2).

The liquid-phase refrigerant separated in the gas-liquid separating space 30*f* is decompressed in the orifice 31*i* of the ejector 13 (from the point g to a point g2 in FIG. 2) and flows out of the liquid-phase refrigerant outlet 31*c*. The liquid-phase refrigerant flowing out of the liquid-phase refrigerant outlet 31*c* flows into the evaporator 14 and evaporates by absorbing heat from the air blown by the blower fan 14*a* (from the point g2 to the point h in FIG. 2). As a result, the air is cooled.

On the other hand, the gas-phase refrigerant separated in the gas-liquid separating space 30*f* is drawn into the compressor 11 and compressed again (from the point f to the point a in FIG. 2).

The ejector refrigeration cycle 10 of the present embodiment operates as described above, and thereby being capable of cooling the air to be blown into the vehicle compartment.

According to the ejector refrigeration cycle 10 of the present embodiment, the refrigerant is drawn into the compressor 11 after a pressure of the refrigerant is increased in the diffuser passage 13*c* of the ejector 13. As a result, kinetic consumption of the compressor 11 is reduced, and thereby the coefficient of performance (COP) of the ejector refrigeration cycle 10 can be improved, as compared to a normal refrigeration cycle in which a refrigerant evaporating pressure in the evaporator is substantially equal to a pressure of the refrigerant drawn into the compressor.

In addition, the ejector 13 of the present embodiment can move the passage defining member 35 by an effect of the element 37. Accordingly, the passage sectional area of the minimum sectional area part of the nozzle passage 13*a* can be adjusted depending on a change of the load in the ejector refrigeration cycle 10. That is, the ejector 13 can be operated appropriately depending on the change of the load in the ejector refrigeration cycle 10.

According to the ejector 13 of the present embodiment, the refrigerant swirls in the swirl space 30*a* serving as the swirl flow generator, such that a pressure of the refrigerant swirling at a location adjacent to the swirl center in the swirl space 30*a* falls to a pressure at which the refrigerant becomes the saturated liquid-phase refrigerant or at which the refrigerant is decompression-boiled (i.e., at which cavitation occurs).

As a result, a state in which the gas-phase refrigerant (i.e., a gas column) is present in a columnar shape on an inner side adjacent to the swirl center is caused, such that a gas-liquid separated state, in which the gas-phase refrigerant swirls adjacent to the swirl center and the liquid-phase refrigerant swirls around the gas-phase refrigerant, is caused in the swirl space 30*a*.

The refrigerant separated into the gas-phase refrigerant and the liquid-phase refrigerant in the swirl space 30*a* and being in the gas-liquid separated state flows into the nozzle passage 13*a*. As a result, a boiling of the refrigerant is promoted in the nozzle passage 13*a* by a boiling of the refrigerant at a wall surface that occurs when the refrigerant separates from an outer wall surface of the refrigerant passage having the annular shape and by an interface boiling of the refrigerant that occurs at a location adjacent to a center axis of the refrigerant passage having the annular shape due to a boiling core caused by the cavitation.

Accordingly, the refrigerant flowing into the minimum sectional area part of the nozzle passage 13*a* is in a gas-liquid mixed state in which the gas-phase refrigerant and the liquid-phase refrigerant are mixed homogeneously. Then, an occlusion (i.e., choking) occurs in a flow of the refrigerant in the gas-liquid mixed state around the minimum sectional area part. A flow speed of the refrigerant in the gas-liquid mixed state increases to a sound speed is accelerated in a bell-shape part and injected.

As described above, the flow speed of the refrigerant in the gas-liquid mixed state can be accelerated effectively to be higher than or equal to the sound speed in a manner that the boiling is promoted both by the boiling of the refrigerant at the wall surface and the interface boiling. As a result, the energy conversion efficiency in the nozzle passage 13*a* can be improved. Therefore, an increase range in a pressure of the refrigerant increased in the diffuser passage 13*c* is increased by improving the energy conversion efficiency, and thereby the COP in the ejector refrigeration cycle 10 can be further improved.

However, according to Raoult's law, a vapor pressure of the liquid-phase refrigerant (i.e., a solvent) mixed with the refrigerant oil (i.e., a non-volatile solute) becomes lower than a vapor pressure of the liquid-phase refrigerant including no refrigerant oil. That is, a saturation pressure at which the liquid-phase refrigerant including the refrigerant oil starts boiling is lower than a saturation pressure at which the liquid-phase refrigerant including no refrigerant oil starts boiling.

The inventors of the present disclosure examined in detail and found that the liquid-phase refrigerant cannot be decompression-boiled in the swirl space 30*a* when the liquid-phase refrigerant includes the refrigerant oil as that of the ejector refrigeration cycle 10 of the present embodiment. As a result, the boiling of the refrigerant passing through the nozzle passage 13*a* cannot be promoted sufficiently. On the other hand, it is found that a pressure energy of the refrigerant, which is utilizable for accelerating the flow speed of the refrigerant to be higher than or equal to the sound speed in the nozzle passage 13*a*, is decreased when a pressure of the refrigerant in the swirl space 30*a* is decreased so as to promote the boiling of the refrigerant passing through the nozzle passage 13*a* sufficiently.

That is, the saturation pressure at which the liquid-phase refrigerant starts boiling is decreased, i.e., vapor-pressure depression occurs, due to Raoult's law when the refrigerant includes the refrigerant oil as that of the ejector refrigeration cycle 10 of the present embodiment.

The energy conversion efficiency in the nozzle passage 13*a* may not be improved sufficiently when the vapor-pressure depression of the liquid-phase refrigerant occurs, and thereby the COP of the ejector refrigeration cycle 10 may not be able to be improved sufficiently.

Then, the ejector refrigeration cycle 10 of the present embodiment has the oil separator 15. As a result, the refrigerant oil can be removed from the refrigerant before the refrigerant flows into the swirl space 30*a* of the ejector 13. In other words, a concentration of the refrigerant oil in the subcooled liquid-phase refrigerant flowing into the swirl space 30*a* of the ejector 13 can be reduced.

Accordingly, the vapor pressure depression of the refrigerant flowing into the swirl space 30*a* can be suppressed, thereby improving the energy conversion efficiency in the nozzle passage 13*a* sufficiently. Therefore, according to the ejector refrigeration cycle 10 of the present embodiment, the COP can be improved sufficiently even when the refrigerant includes the refrigerant oil.

Moreover, according to the ejector refrigeration cycle 10 of the present embodiment, the discharge capacity controller 50*a* of the air conditioning controller 50 controls the refrigerant discharge capacity of the compressor 11 such that the refrigerant evaporating temperature Te in the evaporator 14 approaches to the target evaporating temperature TEO. Accordingly, as shown in FIG. 3, the refrigerant evaporating temperature Te can approach the target evaporating temperature TEO promptly.

Figure 3:
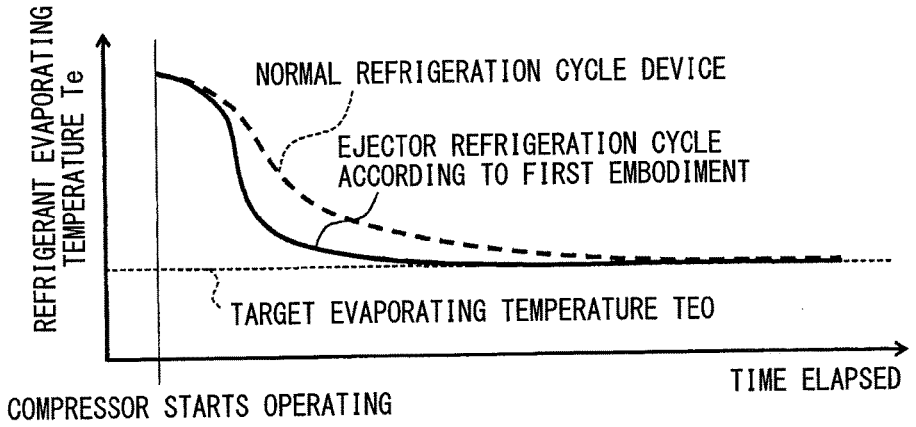
FIG. 3 is a graph showing a variation of a refrigerant evaporating temperature in an evaporator disposed in the ejector refrigeration cycle according to the first embodiment.

A solid line in FIG. 3 shows a variation of the refrigerant evaporating temperature Te when an operation of the ejector refrigeration cycle 10 is started. A dashed line in FIG. 3 shows a variation of the refrigerant evaporating temperature Te when an operation of a normal refrigeration cycle device is started. The normal refrigeration cycle device operates in such a way that a compressor, a radiator, an expansion valve, and an evaporator are connected in circle and that a refrigerant evaporating pressure in the evaporator is substantially equal to a pressure of the refrigerant drawing into the compressor. The normal refrigeration cycle device also has an oil separator having a similar configuration to the oil separator 15 of the present embodiment.

As shown in FIG. 3, the ejector refrigeration cycle 10 of the present embodiment has the oil separator 15, thereby being capable of improving the energy conversion efficiency in the nozzle passage 13*a* promptly even immediately after starting the operation of the ejector refrigeration cycle 10. Accordingly, the refrigerant evaporating temperature Te in the evaporator 14 can be decreased promptly. As a result, the deviation (TEO-Te) between the target evaporating temperature TEO and the refrigerant evaporating temperature Te can be decreased promptly, and thereby the kinetic consumption of the compressor 11 can be further reduced.

The ejector 13 of the present embodiment is provided integrally with the gas-liquid separator in a manner that the gas-liquid separating space 30*f* is defined in the body 30. Accordingly, a size of the ejector refrigeration cycle 10 as a whole can be reduced.

Second Embodiment

Figure 4:
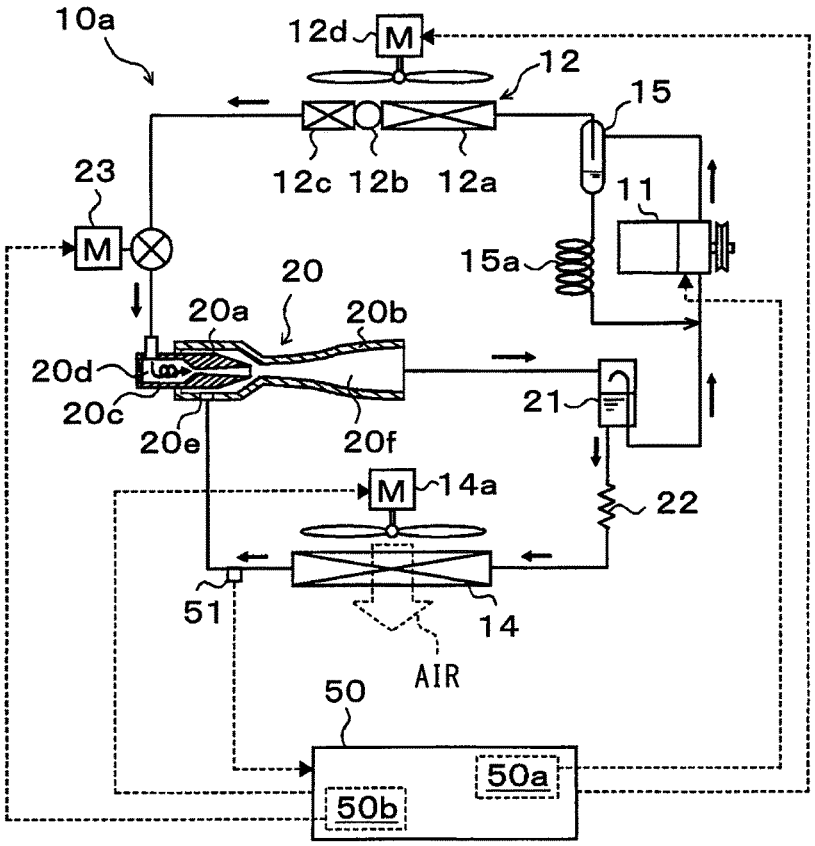
FIG. 4 is a diagram illustrating a whole configuration of an ejector refrigeration cycle according to a second embodiment.

According to the present embodiment, as shown in FIG. 4 illustrating a whole configuration, an ejector refrigeration cycle 10*a* has an ejector 20 and a gas-liquid separator 21 provided separately from each other. A part that corresponds to or equivalent to a matter described in the first embodiment is assigned with the same reference number in FIG. 4.

More specifically, the ejector 20 of the present embodiment has a nozzle 20*a* configured as Laval nozzle in which a flow speed of the injection refrigerant injected from a refrigerant injection port becomes higher than or equal to the sound speed in an normal operation of the ejector refrigeration cycle 10*a*. The nozzle 20*a* may be a tapered nozzle of which passage sectional area (i.e., the refrigerant passage sectional area) decreases gradually.

A tubular portion 20*c* is provided on an upstream side of the nozzle 20*a* in the flow direction of the refrigerant. The tubular portion 20*c* extends coaxially with the nozzle 20*a* in an axial direction of the nozzle 20*a*. The tubular portion 20*c* defines a swirl space 20*d* therein. The swirl space 20*d* causes the refrigerant flowing into the nozzle 20*a* to swirl therein. The swirl space 20*d* extends coaxially with the nozzle 20*a* in the axial direction and has a substantially columnar shape.

A refrigerant inflow passage that guides the refrigerant to flow into the swirl space 20*d* from an outside of the ejector 20 extends in a normal direction of an inner wall surface of the swirl space 20*d* when viewed in a center axis direction of the swirl space 20*d*. Accordingly, the subcooled liquid-phase refrigerant, which flows out of the subcooling portion 12*c* of the radiator 12 and flows into the swirl space 20*d*, flows along the inner wall surface of the swirl space 20*d* similar to the first embodiment, and swirls about the center axis of the swirl space 20*d*.

That is, according to the present embodiment, the tubular portion 20*c* and the swirl space 20*d* configure the swirl flow generator that causes the subcooled liquid-phase refrigerant flowing into the nozzle 20*a* to swirl about an axis of the nozzle 20*a*. In other words, the ejector 20 (specifically the nozzle 20*a*) and the swirl flow generator are configured integrally with each other.

A body 20*b* provides an exterior of the ejector 20. The body 20*b* is made of metal (e.g., aluminum) or resin and has a substantially tubular shape. The body 20*b* serves as a fixing member in which the nozzle 20*a* is located and fixed. More specifically, the nozzle 20*a* is housed in the body 20*b* on one side in a longitudinal direction of the body 20*b* and fixed by press fitting. Accordingly, a leak of the refrigerant from a fixing part (i.e., a press-fitting part) in which the nozzle 20*a* is fixed to the body 20*b*.

The body 20*b* has a refrigerant suction port 20*e* that is open on an outer surface at a location corresponding to the nozzle 20*a* on an outer side of the nozzle 20*a*. The refrigerant suction port 20*e* passes through the body 20*b* to connect an inner side and an outer side of the body 20*b* and communicates with the refrigerant injection port of the nozzle 20*a*. The refrigerant suction port 20*e* is a through hole that draws the refrigerant flowing out of the evaporator 14 from an outside to an inside of the ejector 20 by a suction power of an injection refrigerant injected from the nozzle 20*a*.

The body 20*b* defines a suction passage and a diffuser part 20*f* therein. The suction passage guides a suction refrigerant drawn from the refrigerant suction port 20*e* to flow to the refrigerant injection port of the nozzle 20*a*. The diffuser part 20*f* is the pressure increasing part that mixes the injection refrigerant and the suction refrigerant flowing from the refrigerant suction port 20*e* into the ejector 20 and increases a pressure of a mixture of the injection refrigerant and the suction refrigerant.

The diffuser part 20*f* is arranged to connect an outlet of the suction passage and is a space of which passage sectional area (i.e., the refrigerant passage sectional area) increases gradually. Accordingly, the diffuser part 20*f* increases a pressure of the mixed refrigerant of the injection refrigerant and the suction refrigerant by decreasing a flow speed of the mixed refrigerant while mixing the injection refrigerant and the suction refrigerant. That is, the diffuser part 20*f* converts velocity energy of the mixed refrigerant into pressure energy.

The diffuser part 20*f* has a refrigerant outlet that connects to a refrigerant inlet side of the gas-liquid separator 21. The gas-liquid separator 21 separates the refrigerant flowing out of the diffuser part 20*f* of the ejector 20 into gas-phase refrigerant and liquid-phase refrigerant. The gas-liquid separator 21 exerts the same function as the gas-liquid separating space 30*f* of the first embodiment.

In addition, according to the present embodiment, the gas-liquid separator 21 has a relatively small inner volume so as to guide the liquid-phase refrigerant to flow out of a liquid-phase refrigerant outlet while storing little amount of the liquid-phase refrigerant. However, the gas-liquid separator 21 may serve as a liquid storage portion that stores an excess liquid-phase refrigerant in the refrigeration cycle.

The gas-liquid separator 21 has a gas-phase refrigerant outlet that connects to the suction side of the compressor 11. The liquid-phase refrigerant outlet of the gas-liquid separator 21 connects to the refrigerant inlet side of the evaporator 14 through a fixed throttle 22. The fixed throttle 22 serves similar to the orifice 31*i* of the first embodiment. The fixed throttle 22 may be an orifice, a capitally tube, or the like.

The ejector refrigeration cycle 10*a* of the present embodiment further has a flow rate adjustment valve 23 that is an electric valve and serves as a refrigerant flow rate adjuster. The flow rate adjustment valve 23 is arranged in a refrigerant passage extending from an outlet of the subcooling portion 12*c* of the radiator 12 to an inlet of the ejector 20. The flow rate adjustment valve 23 has a valve body and an electric actuator. The valve body is configured to change the passage sectional area (i.e., the refrigerant passage sectional area). The electric actuator moves the valve body to change the passage sectional area.

The passage sectional area (i.e., the refrigerant passage sectional area) of the flow rate adjustment valve 23 is sufficiently larger than the passage sectional area of the refrigerant passage (i.e., a throttle passage) of the nozzle 20*a* of the ejector 20. Accordingly, the flow rate adjustment valve 23 of the present embodiment can adjust the flow rate of the refrigerant flowing into the nozzle 20*a* while hardly having a refrigerant decompression effect. In addition, an operation of the flow rate adjustment valve 23 is controlled based on the control signal output from the air conditioning controller 50.

The input side of the air conditioning controller 50 of the present embodiment connects to a superheat degree sensor 51 as a superheat degree detector that detects a superheat degree of the refrigerant on the outlet side of the evaporator 14. The superheat degree sensor 51 is one of the sensors for an air conditioning control. More specifically, the superheat degree sensor 51 of the present embodiment detects the superheat degree of the refrigerant flowing in the refrigerant passage extending from the refrigerant outlet of the evaporator 14 to the refrigerant suction port 20*e* of the ejector 20.

The superheat degree detector is not limited to the superheat degree sensor 51 and may be an evaporator outlet side temperature sensor detecting a temperature of the refrigerant on the outlet side of the evaporator 14 or an evaporator outlet side pressure sensor detecting a pressure of the refrigerant on the outlet side of the evaporator 14. The air conditioning controller 50 may calculate the superheat degree based on detection values detected by the evaporator outlet side temperature sensor and the evaporator outlet side pressure sensor.

The air conditioning controller 50 controls an operation of the flow rate adjustment valve 23 such that a detection value detected by the superheat degree sensor 51, specifically, the superheat degree SH of the refrigerant on the outlet side of the evaporator 14, approaches to the reference superheat degree KSH. According to the present embodiment, a superheat degree controller 50*b* is configured by a part (hardware and software) of the air conditioning controller 50 controlling an operation of the flow rate adjustment valve 23.

Other configurations and operations of the ejector refrigeration cycle 10*a* are the same as those of the ejector refrigeration cycle 10 of the first embodiment. That is, the ejector refrigeration cycle 10*a* of the present embodiment has substantially the same cycle configuration as the ejector refrigeration cycle 10 of the first embodiment and operates as the same as described in the first embodiment.

Accordingly, the same effects as the first embodiment can be obtained with the ejector refrigeration cycle 10*a* of the present embodiment. That is, since the ejector refrigeration cycle 10*a* of the present embodiment has the oil separator 15, the COP can be improved sufficiently even when the refrigerant includes the refrigerant oil as described in the first embodiment.

Modifications

It should be understood that the present disclosure is not limited to the above-described embodiments and intended to cover various modification within a scope of the present disclosure as described hereafter. It should be understood that structures described in the above-described embodiments are preferred structures, and the present disclosure is not limited to have the preferred structures. The scope of the present disclosure includes all modifications that are equivalent to descriptions of the present disclosure or that are made within the scope of the present disclosure.

(1) According to the above-described embodiments, the centrifugal oil separator 15 serves as the oil separator. However, the oil separator is not limited to such an example.

For example, a collision-type gas-liquid separator may be employed. The collision-type gas-liquid separator decreases a flow speed of high-pressure refrigerant, compressed in the compressor 11, by causing the high-pressure refrigerant to collide with a collision plate, and stores the refrigerant oil having a greater specific gravity as compared to the liquid-phase refrigerant by leaving the refrigerant oil to fall downward using a force of gravity. Alternatively, the gas-liquid separator may be a surface tension type that further has, in addition to the collision plate, an adhesion plate to which the liquid-phase refrigerant adheres due to surface tension of the liquid-phase refrigerant.

According to the above-described embodiments, the oil separator 15 is provided separately from the compressor 11 or the radiator 12. However, the oil separator may be provided integrally with the compressor 11 or the radiator 12.

For example, the oil separator may be provided integrally with the compressor 11 in a manner that the oil separator is housed inside a housing providing an exterior of the compressor 11. Alternatively, the oil separator may be provided integrally with the compressor 11 in a manner that the oil separator is attached to the housing of the compressor 11 through a bracket or the like.

Moreover, the radiator 12 may have a heat exchanger configuration having a tank and tubes. In this case, the oil separator is provided integrally with the compressor 11 in a manner that the oil separator is attached to a protection member such as a side plate that protects a heat exchanging portion or the tank.

(2) According to the above-described second embodiment, the gas-liquid separator 21 separates the refrigerant flowing out of the diffuser part 20*f* of the ejector 20 into the gas-phase refrigerant and the liquid-phase refrigerant. The liquid-phase refrigerant flows to the refrigerant inlet side of the evaporator 14 through a decompression part, and the gas-phase refrigerant flows to the suction side of the compressor 11. However, the ejector refrigeration cycle of the present disclosure is not limited to have the cycle configuration described in the second embodiment.

For example, a branch portion may be provided to separate a flow of the refrigerant flowing from the radiator 12. In this case, the flow of the refrigerant is branched into two flows by the branch portion. One of the two flow flows into the nozzle 20*a* of the ejector 20, and the other one of the two flow flows to the refrigerant suction port 20*e* of the ejector through the fixed throttle (i.e., the decompression part) and the evaporator 14.

That is, the ejector refrigeration cycle may have the compressor, the radiator, the branch portion, the ejector, the swirl flow generator, the decompression part, the evaporator, and the oil separator.

The compressor compresses the refrigerant including the refrigerant oil to be a high-pressure refrigerant and discharges the high-pressure refrigerant. The radiator causes the high-pressure refrigerant to radiate heat until the high-pressure refrigerant becomes supercooled liquid-phase refrigerant. The branch portion separates a flow of the refrigerant flowing from the radiator into two flows. The ejector has the nozzle and the body. The nozzle decompresses one of the two flows of the refrigerant branched by the branch portion and injects the refrigerant as the injection refrigerant at high speed. The body has the refrigerant suction port and the pressure increasing part. The refrigerant suction port draws refrigerant as the suction refrigerant using suction power of the injection refrigerant. The pressure increasing part mixes the injection refrigerant and the suction refrigerant and increases a pressure of a mixture of the injection refrigerant and the suction refrigerant. The swirl flow generator causes the refrigerant flowing from the radiator to swirl about the center axis of the nozzle and to flow into the nozzle. The decompression part decompresses the other one of the two flows of the refrigerant. The evaporator evaporates the refrigerant, after being decompressed in the decompression part, and guides the refrigerant to flow to the refrigerant suction side. The oil separator separates the refrigerant oil from the high-pressure refrigerant compressed in the compressor, and guides the refrigerant oil to flow to the suction side of the compressor.

(3) Components configuring the ejector refrigeration cycle 10, 10*a* are not limited to those described in the above-described embodiments.

For example, the compressor 11 is operated by a driving force from the engine according to the above-described embodiments. However, the compressor 11 may be an electric compressor that has a fixed capacity compression mechanism and an electric motor and is operated when being energized. The electric compressor can control a refrigerant discharge capacity by adjusting a rotational speed of the electric motor.

According to the above-described embodiments, the radiator 12 is a subcooling heat exchanger, however may be a normal radiator having only the condensing portion 12*a*. Further, a condenser configured integrally with a liquid reservoir (i.e., a receiver) may be disposed in addition to the normal condenser. In this case, the receiver separates refrigerant, after radiating heat in the normal condenser, into gas-phase refrigerant and liquid-phase refrigerant and stores an excess liquid-phase refrigerant.

According to the above-described embodiments, the refrigerant may be R134a, R1234yf, etc., however is not limited to the examples. For example, R600a, R410A, R404A, R32, R1234yf, R1234yfxf, R407C, etc. may be used as the refrigerant. Alternatively, a mixed refrigerant of some of the above materials may be used.

According to the above-described second embodiment, the ejector 20 has a fixed nozzle that has the minimum sectional area part of which passage sectional area is fixed. However, the ejector 20 may has a variable nozzle that has a minimum sectional area part of which passage sectional area is variable.

When using the variable nozzle, a valve body is disposed in a refrigerant passage (i.e., a nozzle passage) in the variable nozzle. The valve body has a cone shape or a needle shape that is tapered from a side adjacent to the diffuser part toward a side adjacent to the variable nozzle. The passage sectional area is adjusted by moving the valve body using an electric actuator etc.

Moreover, the ejector refrigeration cycle 10, 10*a* may further has an interior heat exchanger that performs a heat exchange between high-pressure side refrigerant flowing from the radiator 12 and low-pressure side refrigerant drawn into the compressor 11.

(4) According to the above-described embodiments, the ejector refrigeration cycle 10, 10*a* of the present disclosure is used for the vehicle air conditioner, however is not limited to be used for the vehicle air conditioner. For example, the ejector refrigeration cycle 10, 10*a* may be used for a stationary air conditioner, a cooling storage container, a cooling/heating device for a vending machine, etc.

According to the ejector refrigeration cycle 10, 10*a* of the above-described embodiments, the condenser 12 is an exterior heat exchanger that performs a heat exchange between the refrigerant and the outside air, and the evaporator 14 is a usage-side heat exchanger that cools air. However, the evaporator 14 may be an exterior heat exchanger that absorbs heat from a heat source such as the outside air, and the radiator 12 may be a usage-side heat exchanger that heats a heating target fluid such as the air, water etc.

What is claimed is:

1. An ejector refrigeration cycle comprising:

a compressor that compresses refrigerant, mixed with refrigerant oil, to be a high-pressure refrigerant and discharges the high-pressure refrigerant, the refrigerant oil being compatible with a liquid-phase refrigerant;

a radiator that causes the high-pressure refrigerant discharged by the compressor to radiate heat to be a subcooled liquid-phase refrigerant;

an ejector having a nozzle that decompresses the refrigerant flowing from the radiator and injects the refrigerant as an injection refrigerant at a high speed and a body that has a refrigerant suction port and a pressure increasing part, the refrigerant suction port that draws refrigerant, as a suction refrigerant, using suction power of the injection refrigerant, the pressure increasing part that mixes the injection refrigerant and the suction refrigerant and increases a pressure of a mixture of the injection refrigerant and the suction refrigerant;

a swirl flow generator space that is configured to cause the refrigerant flowing from the radiator to swirl about a center axis of the nozzle at a speed causing a decompression boiling of the refrigerant swirling adjacent to the center axis, the refrigerant flowing into the nozzle;

an evaporator that evaporates refrigerant and guides the refrigerant to the refrigerant suction port;

an oil separator that separates the refrigerant oil from the high-pressure refrigerant compressed by the compressor and guides the refrigerant oil to flow to a suction side of the compressor; and a capillary tube that connects an outlet of the oil separator to the suction side of the compressor, the refrigerant oil being allowed to return to the compressor through the capillary tube, wherein the oil separator decreases a concentration of the refrigerant oil in the refrigerant, which is to flow into the swirl flow generator space, so as to promote the decompression boiling of the refrigerant in the swirl flow generator space.

2. The ejector refrigeration cycle according to claim 1, wherein the body has a gas-liquid separator that separates the refrigerant flowing from the pressure increasing part into a liquid-phase refrigerant and a gas-phase refrigerant, the liquid-phase refrigerant separated in the gas-liquid separator flows to an inlet side of the evaporator, and the gas-phase refrigerant separated in the gas-liquid separator flows to the suction side of the compressor.

3. The ejector refrigeration cycle according to claim 1, further comprising a gas-liquid separator that separates the refrigerant flowing out of the ejector into a liquid-phase refrigerant and a gas-phase refrigerant, wherein the liquid-phase refrigerant separated in the gas-liquid separator flows to an inlet side of the evaporator, and the gas-phase refrigerant separated in the gas-liquid separator flows to the suction side of the compressor.

4. The ejector refrigeration cycle according to claim 1, further comprising a discharge capacity controller that controls a discharge capacity of the compressor, wherein the discharge capacity controller controls the discharge capacity of the compressor such that a refrigerant evaporating temperature in the evaporator approaches a target evaporating temperature.

5. An ejector refrigeration cycle comprising:

a compressor that compresses refrigerant, mixed with refrigerant oil, to be a high-pressure refrigerant and discharges the high-pressure refrigerant, the refrigerant oil being compatible with a liquid-phase refrigerant;

a radiator that causes the high-pressure refrigerant discharged by the compressor to radiate heat to be a subcooled liquid-phase refrigerant;

an ejector having a nozzle that decompresses the refrigerant flowing from the radiator and injects the refrigerant as an injection refrigerant at a high speed and a body that has a refrigerant suction port and a pressure increasing part, the refrigerant suction port that draws refrigerant, as a suction refrigerant, using suction power of the injection refrigerant, the pressure increasing part that mixes the injection refrigerant and the suction refrigerant and increases a pressure of a mixture of the injection refrigerant and the suction refrigerant;

an evaporator that evaporates refrigerant and guides the refrigerant to the refrigerant suction port;

an oil separator that separates the refrigerant oil from the high-pressure refrigerant compressed by the compressor and guides the refrigerant oil to flow to a suction side of the compressor; and a capillary tube that connects an outlet of the oil separator to the suction side of the compressor, the refrigerant oil being allowed to return to the compressor through the capillary tube, wherein the oil separator decreases a concentration of the refrigerant oil in the refrigerant, so as to promote a decompression boiling of the refrigerant.

6. The ejector refrigeration cycle according to claim 5, wherein the body has a gas-liquid separator that separates the refrigerant flowing from the pressure increasing part into a liquid-phase refrigerant and a gas-phase refrigerant, the liquid-phase refrigerant separated in the gas-liquid separator flows to an inlet side of the evaporator, and the gas-phase refrigerant separated in the gas-liquid separator flows to the suction side of the compressor.

7. The ejector refrigeration cycle according to claim 5, further comprising a gas-liquid separator that separates the refrigerant flowing out of the ejector into a liquid-phase refrigerant and a gas-phase refrigerant, wherein the liquid-phase refrigerant separated in the gas-liquid separator flows to an inlet side of the evaporator, and the gas-phase refrigerant separated in the gas-liquid separator flows to the suction side of the compressor.

8. The ejector refrigeration cycle according to claim 5, further comprising a discharge capacity controller that controls a discharge capacity of the compressor, wherein the discharge capacity controller controls the discharge capacity of the compressor such that a refrigerant evaporating temperature in the evaporator approaches a target evaporating temperature.

* * * * *